US008783537B2

(12) United States Patent
Ghassemi

(10) Patent No.: US 8,783,537 B2
(45) Date of Patent: Jul. 22, 2014

(54) ERGONOMIC BACKPACK

(76) Inventor: Romina Ghassemi, San Pedro, CA (US)

( * ) Notice: Subject to any disclaimer, the term of this patent is extended or adjusted under 35 U.S.C. 154(b) by 81 days.

(21) Appl. No.: 13/193,475

(22) Filed: Jul. 28, 2011

(65) Prior Publication Data

US 2012/0024926 A1 Feb. 2, 2012

Related U.S. Application Data

(60) Provisional application No. 61/368,569, filed on Jul. 28, 2010.

(51) Int. Cl.

| | |
|---|---|
| ***A45F 4/02*** | (2006.01) |
| ***A45F 3/04*** | (2006.01) |
| ***A45F 3/00*** | (2006.01) |

(52) U.S. Cl.
USPC ..... 224/628; 224/153; 224/627; 224/633

(58) Field of Classification Search
USPC ..... 224/628, 627, 645, 153, 633; 601/128
See application file for complete search history.

(56) References Cited

U.S. PATENT DOCUMENTS

| | | | | |
|---|---|---|---|---|
| 2,227,724 | A * | 1/1941 | Kosa, Sr. | 601/132 |
| 3,141,456 | A | 7/1964 | Meek | |
| 3,277,889 | A | 10/1966 | Palmer | |
| 3,338,236 | A | 8/1967 | McLeod, Jr. | |
| 3,382,868 | A | 5/1968 | Stiefel | |
| 3,856,004 | A | 12/1974 | Cox | |
| 3,897,776 | A | 8/1975 | Gaylord, Jr. | |
| 4,015,759 | A | 4/1977 | Dreissigacker et al. | |
| 4,169,466 | A * | 10/1979 | Wong | 601/131 |
| 4,214,685 | A | 7/1980 | Pletz | |
| RE30,500 | E | 2/1981 | Springer et al. | |
| 4,421,110 | A * | 12/1983 | DeLisle et al. | 601/134 |
| 4,479,595 | A | 10/1984 | Opsal | |
| 4,796,616 | A * | 1/1989 | Panahpour | 601/131 |
| 4,883,207 | A | 11/1989 | McArthur | |
| 4,936,294 | A * | 6/1990 | Chu | 601/136 |
| 4,982,884 | A | 1/1991 | Wise | |
| 5,105,490 | A * | 4/1992 | Shek | 5/693 |
| 5,120,288 | A | 6/1992 | Sinaki | |
| 5,131,576 | A | 7/1992 | Turnipseed | |
| 5,263,474 | A * | 11/1993 | Agader | 601/113 |
| 5,395,306 | A | 3/1995 | Bauerfeind et al. | |
| 5,487,498 | A | 1/1996 | Gleason | |
| 5,503,314 | A | 4/1996 | Fiscus | |
| 5,545,456 | A * | 8/1996 | Suida | 428/76 |
| 5,553,759 | A | 9/1996 | McMaster et al. | |
| 5,577,648 | A | 11/1996 | Sason et al. | |

(Continued)

FOREIGN PATENT DOCUMENTS

| | | | | |
|---|---|---|---|---|
| CN | 201178772 Y * | 1/2009 | | A45C 15/00 |

*Primary Examiner* — Justin Larson
*Assistant Examiner* — Lester L Vanterpool
(74) *Attorney, Agent, or Firm* — Inskeep IP Group, Inc.

(57) ABSTRACT

An embodiment of the present invention provides a backpack for wearing on a back of a user. The backpack includes at least one cargo compartment, two straps, and a frame. The cargo compartment is wider at a top end of the cargo compartment than at the bottom end. The frame has a first portion located adjacent to one side of the user's spine and a second portion located adjacent to the other side of the user's spine. The first and second portions are shaped to be complementary to the user's spine. Also, massaging beads are located in the frame and massage muscles on each side of the user's spine.

18 Claims, 23 Drawing Sheets

(56) References Cited

U.S. PATENT DOCUMENTS

| | | | | |
|---|---|---|---|---|
| 5,628,772 | A * | 5/1997 | Russell | 607/109 |
| 5,725,484 | A * | 3/1998 | Burnham | 601/128 |
| 5,730,347 | A | 3/1998 | Finot | |
| 5,762,243 | A | 6/1998 | McMaster et al. | |
| 5,787,541 | A * | 8/1998 | Chen | 15/222 |
| 5,806,740 | A | 9/1998 | Carlson | |
| 5,806,742 | A * | 9/1998 | Mott et al. | 224/645 |
| 5,823,414 | A | 10/1998 | Gal et al. | |
| 5,890,640 | A | 4/1999 | Thompson | |
| 5,971,244 | A | 10/1999 | Jaeger | |
| 6,036,067 | A * | 3/2000 | Alcorn | 224/153 |
| 6,164,509 | A | 12/2000 | Gausling et al. | |
| 6,174,297 | B1 * | 1/2001 | Chen | 601/128 |
| 6,179,187 | B1 | 1/2001 | Lemire et al. | |
| 6,190,342 | B1 | 2/2001 | Taylor | |
| 6,276,584 | B1 | 8/2001 | McLachlan | |
| 6,283,350 | B1 | 9/2001 | Gottmeier et al. | |
| 6,315,747 | B1 | 11/2001 | Toole | |
| 6,332,566 | B1 | 12/2001 | Rota | |
| 6,440,094 | B1 | 8/2002 | Maas | |
| 6,589,143 | B2 * | 7/2003 | Taylor | 482/134 |
| 6,607,107 | B2 | 8/2003 | Dexheimer | |
| 6,626,341 | B2 | 9/2003 | Mitchell | |
| 6,626,342 | B1 | 9/2003 | Gleason | |
| 6,820,783 | B2 * | 11/2004 | Beale | 224/644 |
| 6,824,030 | B1 | 11/2004 | Dolan | |
| 6,892,915 | B2 | 5/2005 | Mares | |
| 6,982,497 | B2 | 1/2006 | Rome | |
| 6,991,611 | B2 | 1/2006 | Rhee | |
| 7,028,873 | B1 | 4/2006 | Collier et al. | |
| 7,134,969 | B2 | 11/2006 | Citron et al. | |
| 7,168,873 | B2 * | 1/2007 | Shawan et al. | 401/6 |
| 7,207,953 | B1 | 4/2007 | Goicaj | |
| 7,391,123 | B2 | 6/2008 | Rome | |
| 7,404,506 | B1 | 7/2008 | Ross | |
| 7,452,339 | B2 * | 11/2008 | Mattison | 601/15 |
| 7,481,783 | B1 | 1/2009 | Kelley | |
| 7,578,798 | B2 | 8/2009 | Rhee | |
| 7,631,792 | B2 | 12/2009 | Christy | |
| 7,749,146 | B2 * | 7/2010 | Burns | 482/148 |
| 7,842,000 | B2 | 11/2010 | Lai et al. | |
| 7,846,113 | B2 * | 12/2010 | Ferber et al. | 601/94 |
| 8,316,488 | B2 * | 11/2012 | Rojas | 5/637 |
| 2002/0074374 | A1 | 6/2002 | Holbl | |
| 2002/0158097 | A1 * | 10/2002 | Beale | 224/644 |
| 2003/0062391 | A1 * | 4/2003 | Mitchell | 224/576 |
| 2004/0006293 | A1 * | 1/2004 | Huang | 601/134 |
| 2004/0228548 | A1 * | 11/2004 | Arnell | 383/63 |
| 2006/0113343 | A1 | 6/2006 | Chang | |
| 2008/0185411 | A1 | 8/2008 | Rome et al. | |
| 2009/0015022 | A1 | 1/2009 | Rome et al. | |
| 2009/0201671 | A1 | 8/2009 | Huntley | |
| 2009/0249700 | A1 * | 10/2009 | Peterson et al. | 52/2.17 |
| 2010/0301085 | A1 * | 12/2010 | Smith | 224/637 |
| 2010/0308095 | A1 * | 12/2010 | Lam | 224/644 |
| 2011/0290843 | A1 * | 12/2011 | Sagan | 224/637 |

* cited by examiner

ERGONOMIC BACKPACK

RELATED APPLICATIONS

This application claims priority to U.S. Provisional Application Ser. No. 61/368,569 filed Jul. 28, 2010 entitled Ergonomic Backpack, which is hereby incorporated herein by reference.

BACKGROUND OF THE INVENTION

Backpacks are a convenient device for transporting items, such as books, sports gear, and travel gear, since the items may simply be inserted into the backpack and then the user can wear the backpack on her or his back. However, when loaded, conventional backpacks may be heavy and may distribute weight on the back of the user in an unhealthy manner. Further, the user's back may become fatigued due to wearing the conventional backpack over an extended period of time, which may cause muscles in the users back to cramp or feel tight or uncomfortable.

SUMMARY OF THE INVENTION

An aspect of an embodiment of the present invention is directed towards an ergonomic backpack.

An embodiment of the present invention provides a backpack for wearing on a back of a user. The backpack includes at least one cargo compartment, two straps, and a frame. The at least one cargo compartment is wider at a top end of the cargo compartment than at the bottom end. Each strap is adapted to be worn over a shoulder of the user, and each strap is attached to the top of the cargo compartment at one end and attached to a side of the cargo compartment at the other end. The frame is coupled to the cargo compartment and against a wall of the cargo compartment that is against the back of the user. The frame has a first portion located adjacent to one side of the user's spine and a second portion located adjacent to the other side of the user's spine. The first and second portions are shaped to be complementary to the user's spine. Also, massaging beads are located in the frame and massage muscles on each side of the user's spine.

Another embodiment according to the present invention is directed towards a posture device or brace for maintaining desirable or ergonomic back and shoulder posture. Preferably, the brace is worn underneath clothing and preferably composed of a relatively thin material so as to prevent it from being seen underneath a user's clothing.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
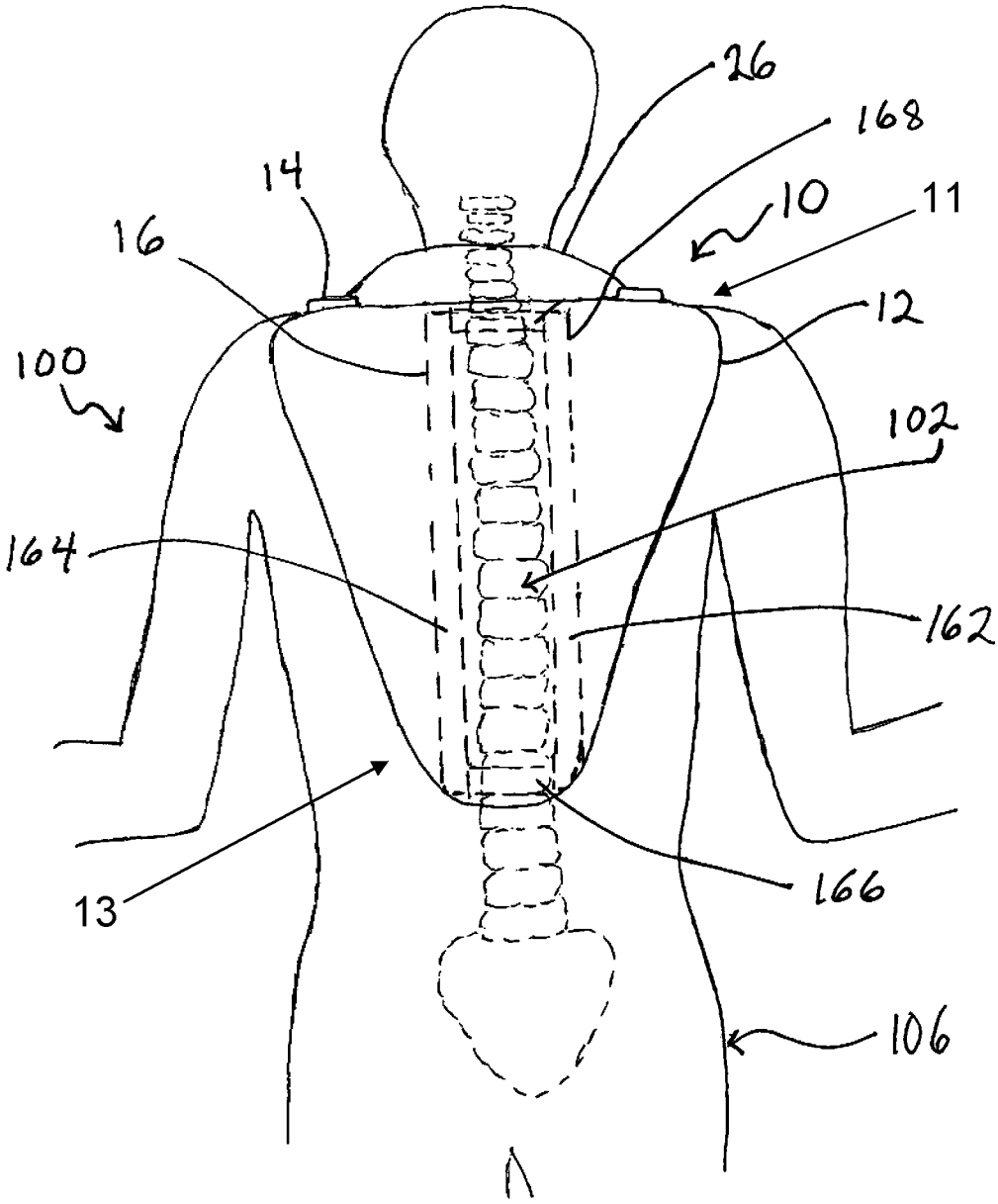
FIG. 1 shows a transparent rear view of a user wearing a backpack according to an embodiment of the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Figure 2:
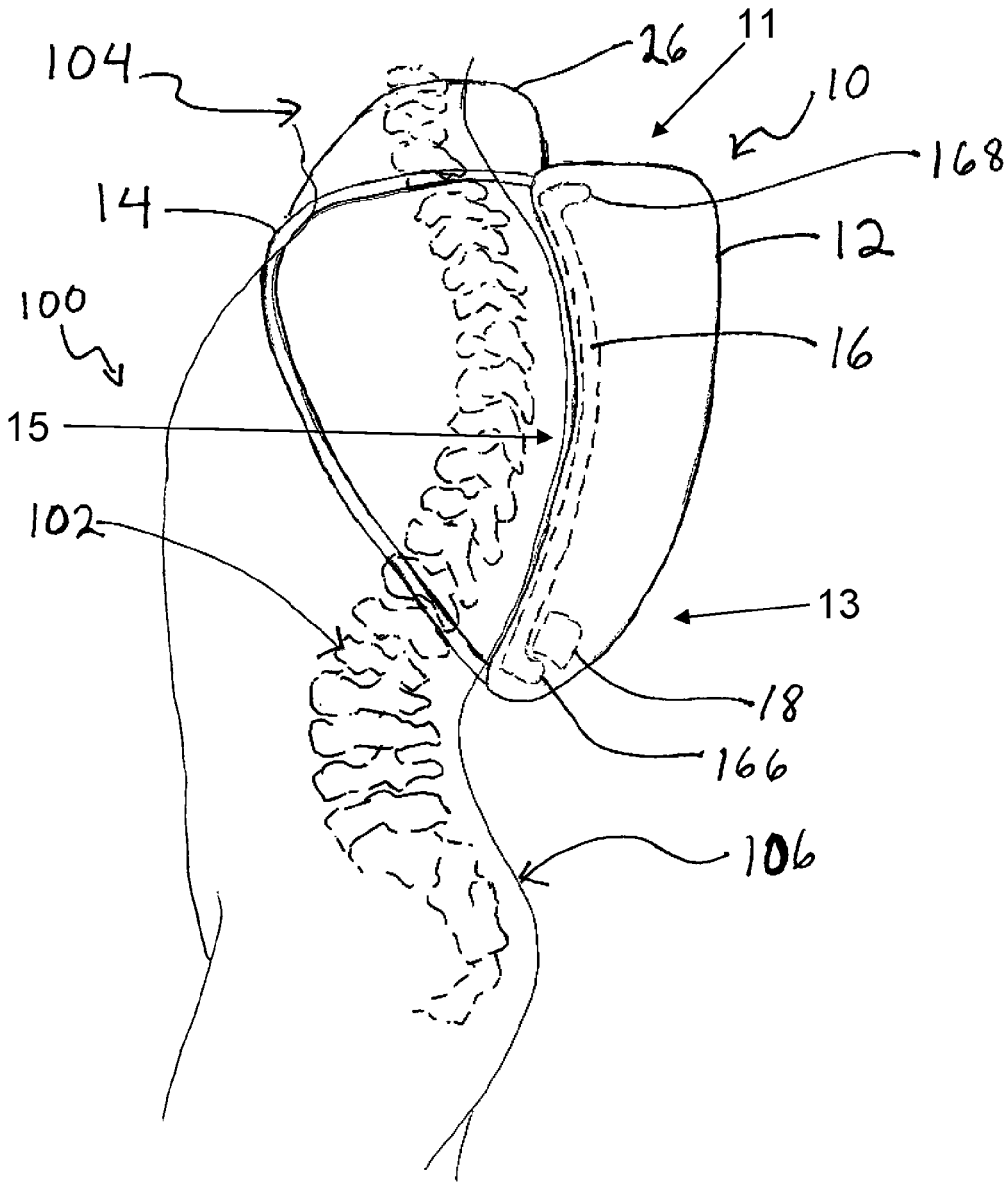
FIG. 2 shows a transparent side view of a user wearing a backpack according to an embodiment of the present invention.

In an embodiment of the present invention as shown in FIGS. 1 and 2, a backpack 10 is formed such that the weight of the load in the backpack 10 is distributed in a healthier and more ergonomic manner than in a conventional backpack. Here, due in part to the shape of the backpack 10, the load is positioned higher on the back of a user 100 than with a conventional backpack. The backpack 10 includes two straps 14, where one strap 14 is placed over each shoulder of the user 100. Therefore, the weight of the load is distributed through the straps 14 and onto the shoulders. The weight distribution on the upper back allows the center of gravity to move posterior, causing an upright posture and avoiding overload on shoulders and lower back.

The backpack 10 is configured to have a top end 11 that is oriented upwards relative to the wearer, a bottom end 13 that is oriented downwards relative to the wearer and a back-facing side 15 that is oriented towards a wearer's back.

In the embodiment of the present invention shown in FIGS. 1 and 2, the backpack 10 includes a cargo compartment 12 formed of a suitable material, such as canvas, nylon fabric or plastic, which is wider at the top end of the cargo compartment 12, near the user's neck 104, than at the bottom end of the cargo compartment 12, near the user's hips 106. In other words, the cargo compartment 12 has a substantially triangular shape. Conventional backpacks tend to be either the same width along the length of the backpack or wider at the bottom than at the top. Due to the cargo compartment 12 of the present invention having this shape, roughly that of an inverted triangle, items loaded into the cargo compartment 12 tend to be positioned higher with respect to the back of the user 100 when the backpack 10 is fully loaded than in a conventional backpack. In other words, because the backpack 10 is narrower at the bottom than at the top, fewer items fit into the bottom than the top. Therefore, since more items are near the top of the backpack 10, most of the weight of the items is near the top of the backpack 10 when fully loaded, moving the center of gravity for the loaded backpack higher on the user's back toward the shoulders.

The backpack 10 shown in FIGS. 1 and 2 also includes a frame 16. As shown in FIG. 1 the frame 16 is shaped so that a first portion 162 is located on one side of the user's spine 102 and a second portion 164 is located on the other side of the user's spine 102. Portions 162 and 164 may be roughly parallel to one another on either side of the spine. Alternatively, the two portions may taper slightly toward one another as they extend down the back. In an alternative embodiment, the side portions of the frame each open outward at about a 3 to 6 degree angle from vertical as they extend toward the top of the frame.

As shown in FIG. 2, the frame 16 is curved along a vertical length so that the shape of the frame 16 is complementary to the shape of the spine 102. Preferably, the frame curves in a direction away from the wearer and into the cargo compartment 12, between the top end 11 and bottom end 13 of the backpack 10 and has a radius of curvature similar to that of the upper area of a human back (e.g. between 2 and 10 degrees).

Figure 4:
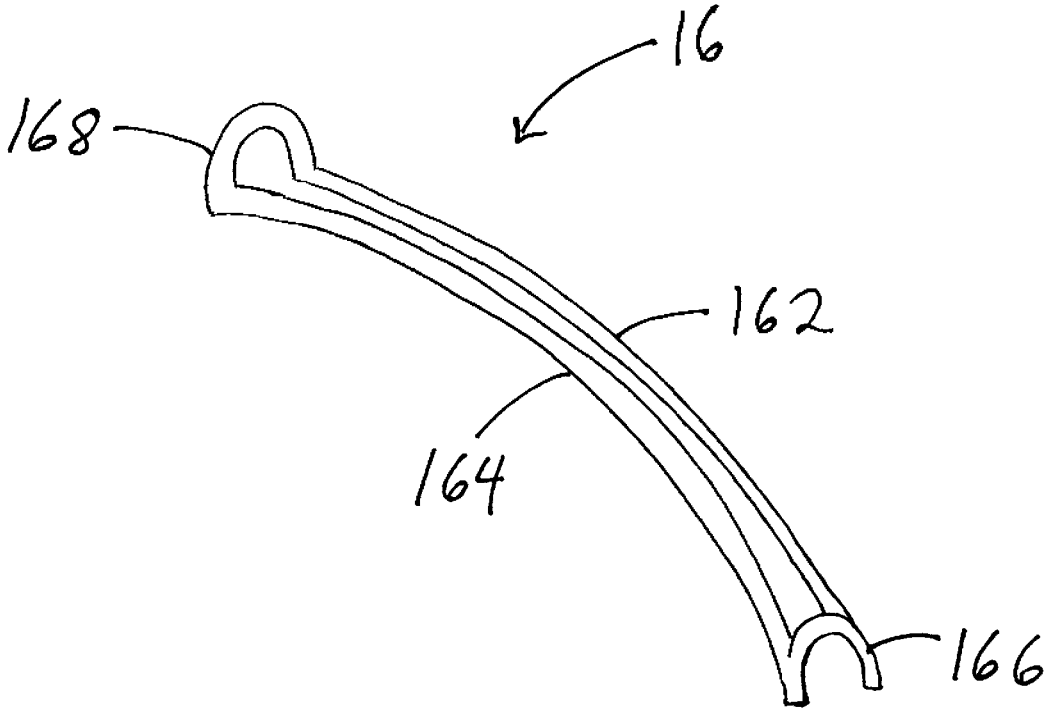
FIG. 4 shows a perspective view of a frame according to an embodiment of the present invention.
Figure 5:
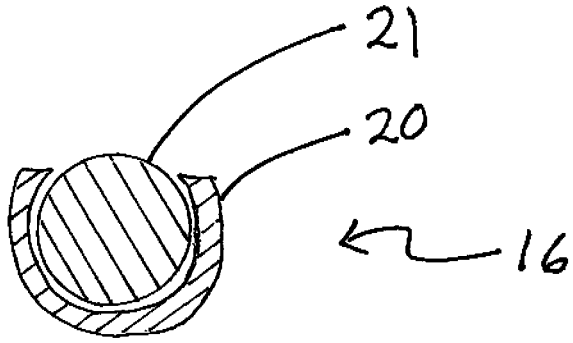
FIG. 5 shows a cross-sectional view of a frame according to an embodiment of the present invention.

As shown in FIGS. 1, 2, and 4, the frame 16 has a top portion 168 and a bottom portion 166 that curve away from the spine 102. In other words, the top portion 168 and the bottom portion 166 act like a bridge so that these portions of the frame 16 do not press against the spine 102.

Further, the backpack 10 includes a frame 16 that provides a massage to the muscles on either side of the spine of the user 100. Here, the massage provided by the frame 16 helps to relieve pain in these muscles due to tightness or carrying a heavy load in the backpack. Furthermore, the massage provides a pleasant and relaxing sensation for the user 100. Massage to the para-spinal muscles (or muscles next to the spine 102) increases blood circulation and stimulates neural response to help relax tension on the muscles. This results in reduced fatigue to the soft tissue structure around the spine 102.

In an embodiment of the present invention, the frame 16 provides a massage to the muscles on either side of the spine 102. For example, the frame 16 may vibrate or pulsate. Also, the frame 16 may be either heated or cooled. A frame control unit 18, as shown in FIG. 2, may control these functions (e.g., via a microcontroller) and may provide a user inter face for direct user control (e.g., buttons). Though the frame control unit 18 is shown near the bottom of the cargo compartment 12, one of ordinary skill in art will understand that the frame control unit 18 may be located in any suitable location in or on the backpack 10.

In one embodiment, a frame 16 may provide oscillating or variable pressure on these muscles, as shown in FIGS. 5, 6A, 6B, and 7. The frame 16 includes a plurality of beads 21 or balls contained within a casing 20, where the casing 20 is shaped so that the beads 21 may move along the interior of the casing. The beads 21 may be formed of any hard or flexible material, such as metal, silicone, or plastic. Further, the casing 20 may be formed of one or more rigid materials, such as metal, silicone, or plastic. The casing 20, which forms the frame 16, may be made, at least in part, of a sturdy material so as to provide a support structure for the backpack. For example, the casing 20 may be formed of metal and lined with silicone to facilitate movement of the beads 21 within the casing 20. The frame control unit 18 may also control movement of the beads 21.

Figure 6A:
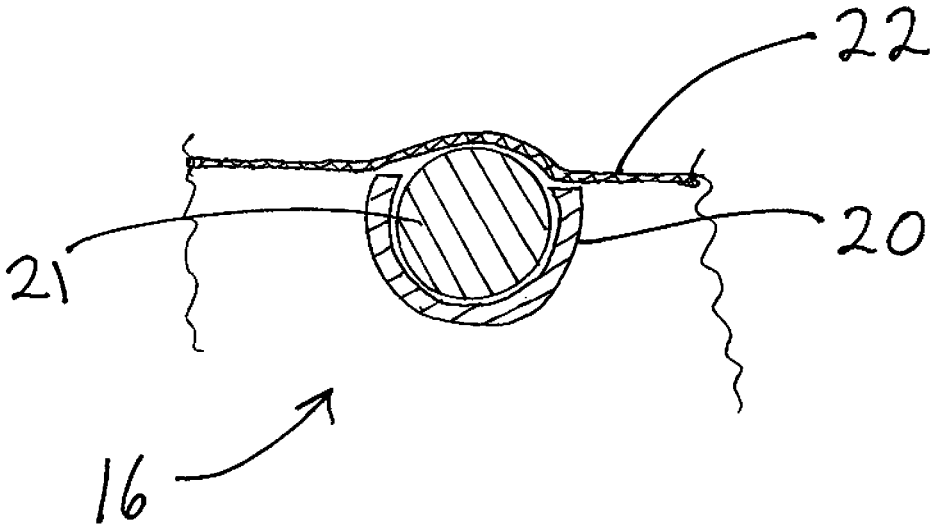
FIG. 6A shows a cross-sectional view of an installed frame according to an embodiment of the present invention.

When the frame is positioned in the backpack 10, a covering 22 covers the beads, as shown in FIG. 6A. Here, the beads 21 press against the covering 22 as the beads 21 move along the casing 20, so the covering 22 is formed of a suitable flexible material to allow the beads 21 to glide or slide along the covering 22. For example, the covering 22 may be formed of silicone or nylon. Further, the covering 22 may be a separate covering that encases the casing 20 or may be the fabric forming the panel of the backpack 10 that is positioned against the back of the user 100. In another embodiment, the frame 16 may be contained within a fabric pouch attached to this panel.

Figure 6B:
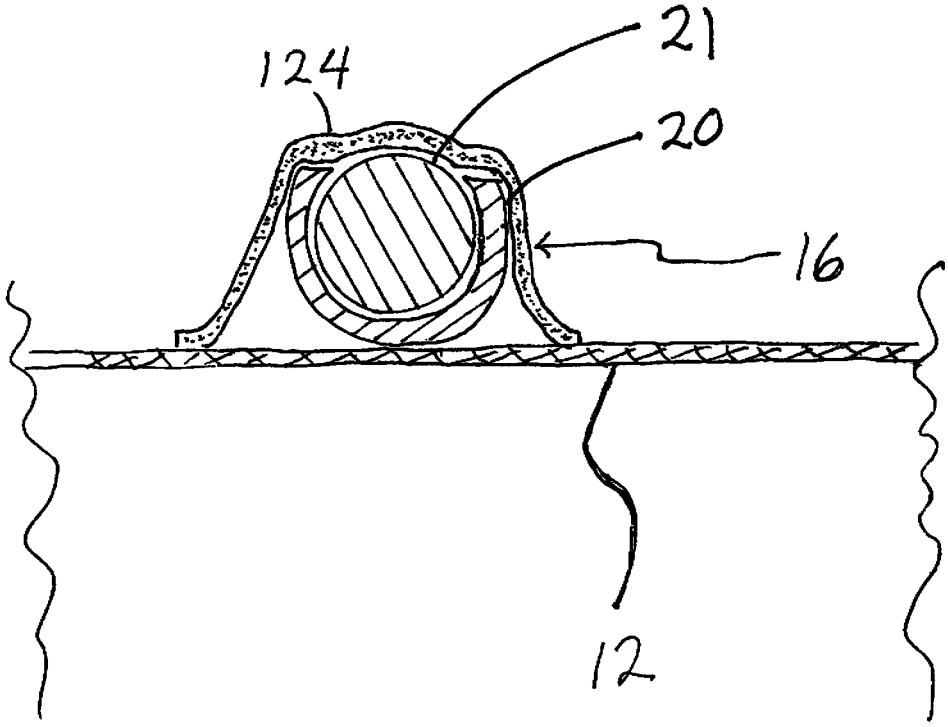
FIG. 6B shows a cross-sectional view of an installed frame according to another embodiment of the present invention.

In another embodiment of the present invention, the frame 16 is positioned outside of the cargo compartment 12, as shown in FIG. 6B. Here, the frame 16 may be coupled to the outside of the cargo compartment 12 via a sleeve 124. One of ordinary skill in the art will appreciate that there are various other methods of attaching the frame 16 to the cargo compartment 12, such as straps, bands, rivets, screws, or adhesives. Further, the frame 16 may be encased a suitable material, such as silicone or nylon fabric, and this material may be attached to the cargo compartment 12 via any suitable attachment method, such as straps, bands, rivets, screws, or adhesives. In any case, the frame 16 is positioned so that movement of the beads 21 can be felt by the user 100 at her or his muscles adjacent to the spine 102.

Figure 7:
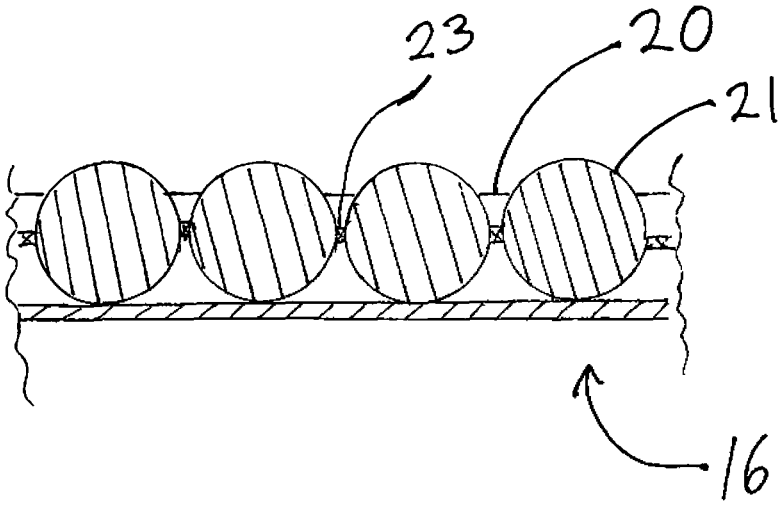
FIG. 7 shows a cross-sectional view of a frame according to an embodiment of the present invention.

As shown in FIG. 7, the plurality of beads 21 may be connected by a plurality of links 23 (or one or more cords or strings) so that the beads 21 move along the casing 20 together. In other words, when one bead 21 is pulled, the other beads 21 are pulled along as well. For example, the beads 21 may be moved back and forth to create a pulsating sensation for the user 100, and/or the beads 21 may be moved in one direction only. In some embodiments, the speed of the movement of the beads 21 may be adjustable by the user.

In one embodiment of the present invention, the beads 21 move in an oscillating motion, where each bead 21 moves about 2 inches above and 2 inches below a neutral (or non-operating) position.

One of ordinary skill in the art will appreciate that there are a variety of methods of moving the beads 21 along the casing 20. For example, the frame control unit 18 may control a motor that turns a screw that is appropriately sized to receive the beads 21. As the screw turns, the beads 21 are moved along the screw, which also moves the beads 21 along the casing 20.

The tops of the beads 21 above the casing 20 press through the covering 22 and/or the panel of the backpack 10 that is against the back of the user 100 so that the user 100 feels the movement of the beads 21 in the first portion 162 and second portion 164 of the frame along the muscles on either side of the spine 102. The movement of the beads 21 results in a sensation of variable pressure on these muscles. The variable pressure massages the muscles, which provides the user with a pleasant sensation of tension, tightness, or fatigue in the muscles being relieved. The user 100 does not feel the movement of the beads 21 in the top portion 168 and the bottom portion 166 because the top portion 168 and the bottom portion 166 are curved away from the spine 102, since variable pressure on the bones of the spine 102 would generally be uncomfortable.

Figure 8:
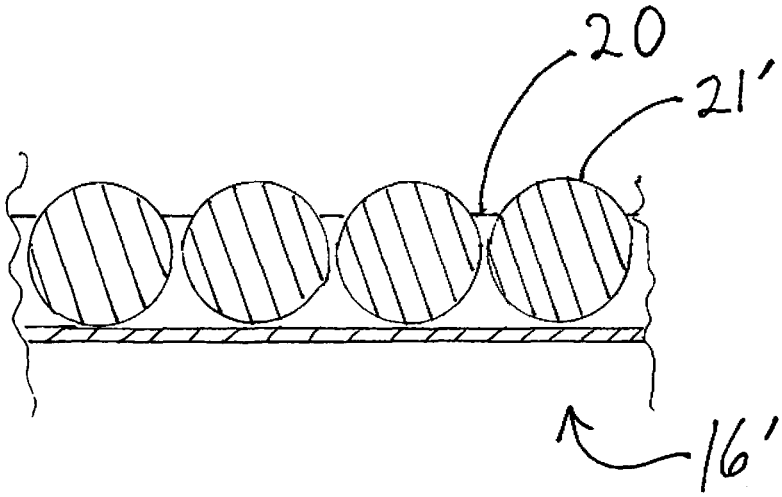
FIG. 8 shows a cross-sectional view of a frame according to another embodiment of the present invention.

In another embodiment of the present invention as shown in FIG. 8, the beads 21' are not connected. Here, movement of one bead 21' pushes the other beads 21'along the casing 20 of this frame 16' to also create a sensation of variable pressure for the user 100.

As noted above, in one embodiment the beads circulate around the entire frame. However, in an alternative embodiment, top and bottom portions 168 and 166 provide support for the frame but need not provide a pathway for the massage beads. In such an embodiment, the beads may be arranged so that they can move independently up and down within each of the side portions.

In an embodiment of the present invention, power is provided to the frame control unit 18 from a solar panel located on the backpack 10. For example, the solar panel may be located on one or both of the shoulder straps 14, and may be a 2 inch by 4 four inch panel that is charged throughout the day as the user 100 wears the backpack 10 or positions the backpack 10 so that it is exposed to sunlight.

One of ordinary skill in the art will appreciate that there are various other methods of providing power to the frame control unit 18. For example, disposable or rechargeable batteries may be used to provide power to the frame control unit 18.

In the embodiment of the present invention shown in FIGS. 1 and 2, the backpack 10 also includes a neck support 26 for the neck 104 of the user 100. The neck support 26 encourages proper alignment of the neck 104 with respect to the rest of the spine 102. Further, the neck support 26 may be adapted to support some of the weight of the head of the user 100.

For example, the neck support 26 stabilizes the base of the skull of the user 100 on the spine 102. Because a user's skull may weigh six to fifteen pounds, this stabilization should additionally reduce the load and shift the gravitational weight load. The neck support 26 may be a memory foam which is formed at a 45 degree curve to support the cervical spine, which is the natural normal curve of the cervical spine, for maximum weight distribution. The neck support 26 may gradually reduce in size to blend into the shoulder straps 14, as shown in FIG. 2.

Figure 9A:
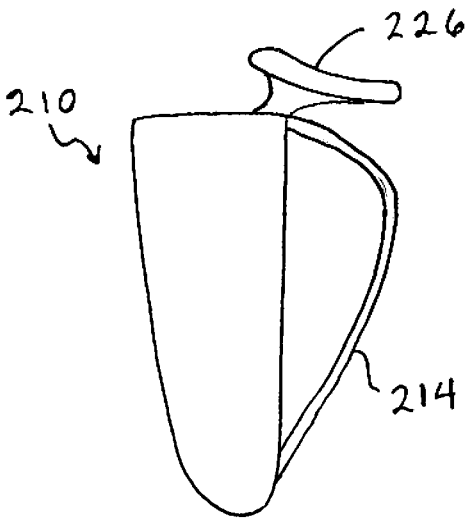
FIG. 9A shows a side view of a backpack according to another embodiment of the present invention.
Figure 9B:
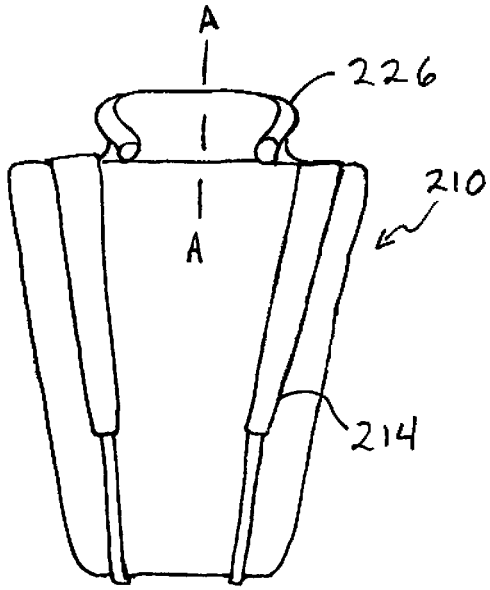
FIG. 9B shows a front view of the backpack of FIG. 9A.
Figure 9C:
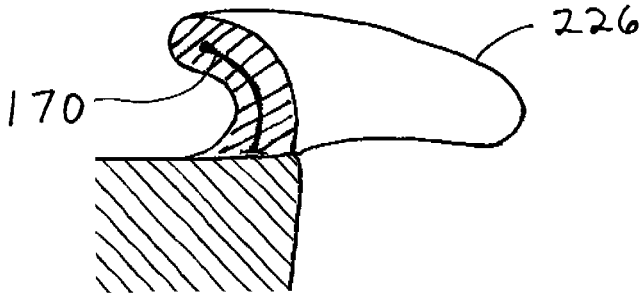
FIG. 9C shows a cross-sectional view of a neck support of the backpack of FIGS. 9A and 9B through line A-A.
Figure 13:
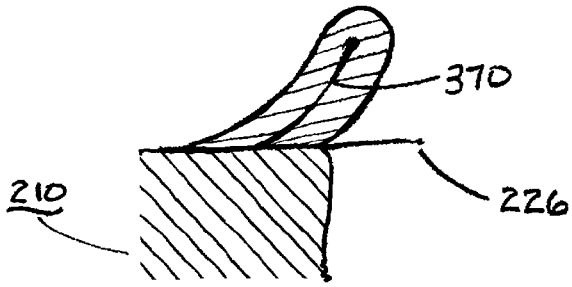
FIG. 13 shows a cross-sectional view of a neck support according to a further embodiment of the present invention.

FIGS. 9A, 9B, and 9C show another embodiment of the backpack 210. Here, the neck support 226 is formed to extend forward beyond the front edge of the backpack 210. Further, the neck support 226 may also be formed of memory foam. However, the memory foam may be positioned about an internal brace 170. The brace 170 may be formed of a suitable rigid material, such as plastic or metal. The brace 170 provides additional support or firmer support for the neck and head of the user 100. The shoulder straps 214 may be similar to any of the shoulder straps discussed above. FIG. 13 shows an alternative embodiment of this type of neck support having a different orientation. The internal brace 370 may be made of a rigid, yet bendable material so that the orientation of the memory foam relative to the user's neck may be adjustable.

Figure 10A:
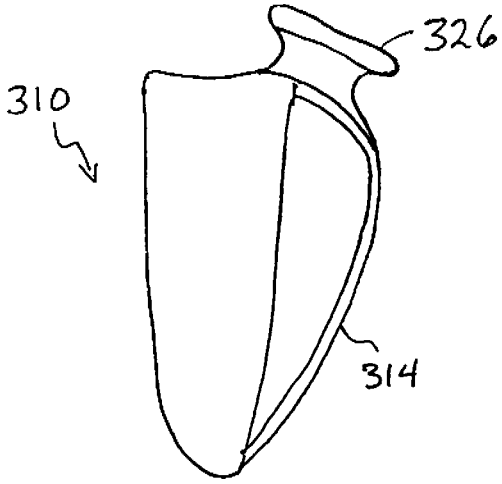
FIG. 10A shows a side view of a backpack according to another embodiment of the present invention.
Figure 10B:
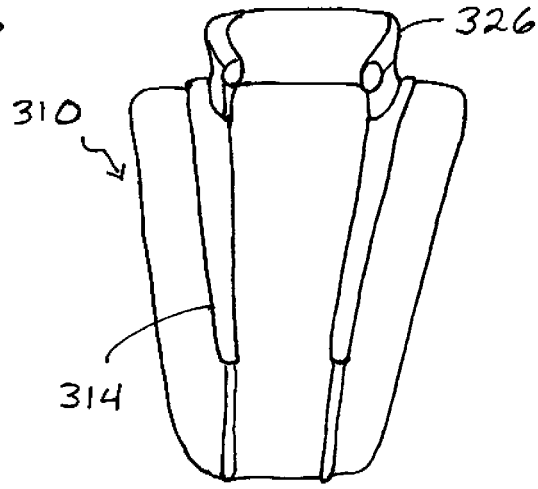
FIG. 10B shows a front view of the backpack of FIG. 10A.

FIGS. 10A and 10B show another embodiment of the backpack 310. Here, the neck support 326 extends forward on the shoulder strap 314 so that the shoulder strap 314 provides some of the support of the neck support 326. The neck support 326 may also be formed of a memory foam or another suitable material, and may include an internal brace, as described above.

Figure 11:
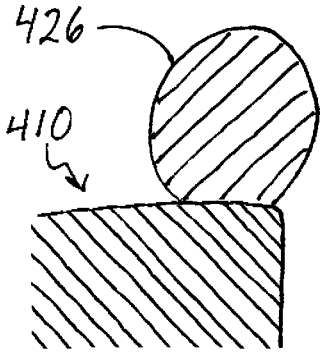
FIG. 11 shows a cross-sectional view of a neck support according to an embodiment of the present invention.

FIG. 11 shows a cross-sectional view of another embodiment of the backpack 410 where the neck support 426 has a roll shape around the neck and a round cross-sectional shape. Here, the neck support 426 may also be formed of memory foam or another suitable material.

Figure 12:
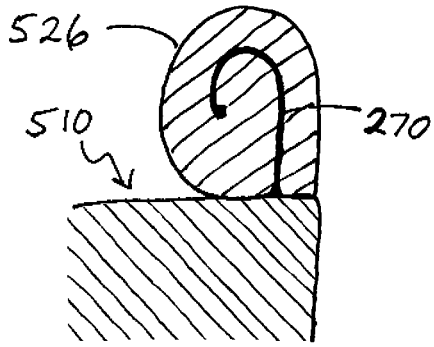
FIG. 12 shows a cross-sectional view of a neck support according to another embodiment of the present invention.

FIG. 12 shows a cross-sectional view of another embodiment of the backpack 510 where the neck support 526 has a roll shape around the neck and a round cross-sectional shape. However, this neck support 526 has an internal brace 270, which may be formed of a suitable rigid material, such as plastic or metal. The brace 270 provides additional support or firmer support for the neck and head of the user 100.

Figure 14:
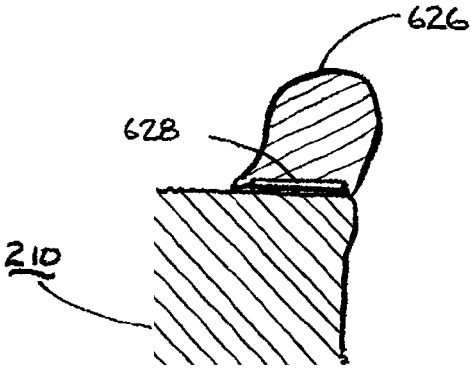
FIG. 14 shows a cross-sectional view of a removable neck support according to an embodiment of the present invention.

FIG. 14. shows a cross-sectional view of a removable neck support 626. In this embodiment, the roll forming the body of the neck support is removably attached to the top of the backpack 210 and/or the shoulder straps at connector 628. The connector may be formed by hook and pile fasteners or press snap fasteners, where one side of the fasteners is fixedly attached to the underside of the roll and the other mating side is fixedly attached to the top of the backpack and/or shoulder straps. Other types of removable fastening means may also be used.

Figure 15:
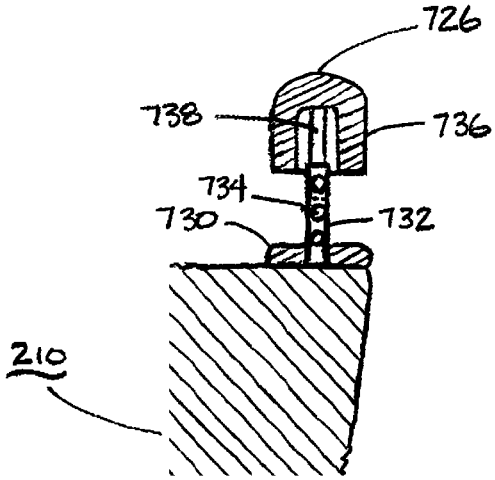
FIG. 15 shows a cross-sectional view of a height adjustable neck support according to an embodiment of the present invention.

FIG. 15 shows a cross-sectional view of a height adjustable neck support 726. In this embodiment, a lower base 730 of the neck support is mounted to the top of the backpack and/or shoulder straps. One or more hollow cylindrical posts 732 are connected at a lower end to the base 730 and project upward from that base. Multiple posts may be used at points spaced along the neck support to provide even adjustability for the neck support. Openings 734 are located in the sidewall of the posts at different heights. An upper portion 736 of the neck support has an inverted "U"-shaped cross section. Upper posts 738, which correspond with each of the hollow cylindrical posts 732, are attached to the upper portion and extend down from the base of the "U." A spring-loaded button extends outwardly from the sidewall of each upper post. These buttons are adapted to be received in a selected opening 734 on the hollow cylindrical posts. By depressing the buttons, the upper posts may be moved up and down within the lower hollow posts to a selected height, thereby allowing for height adjustment of the neck support.

Figure 3:
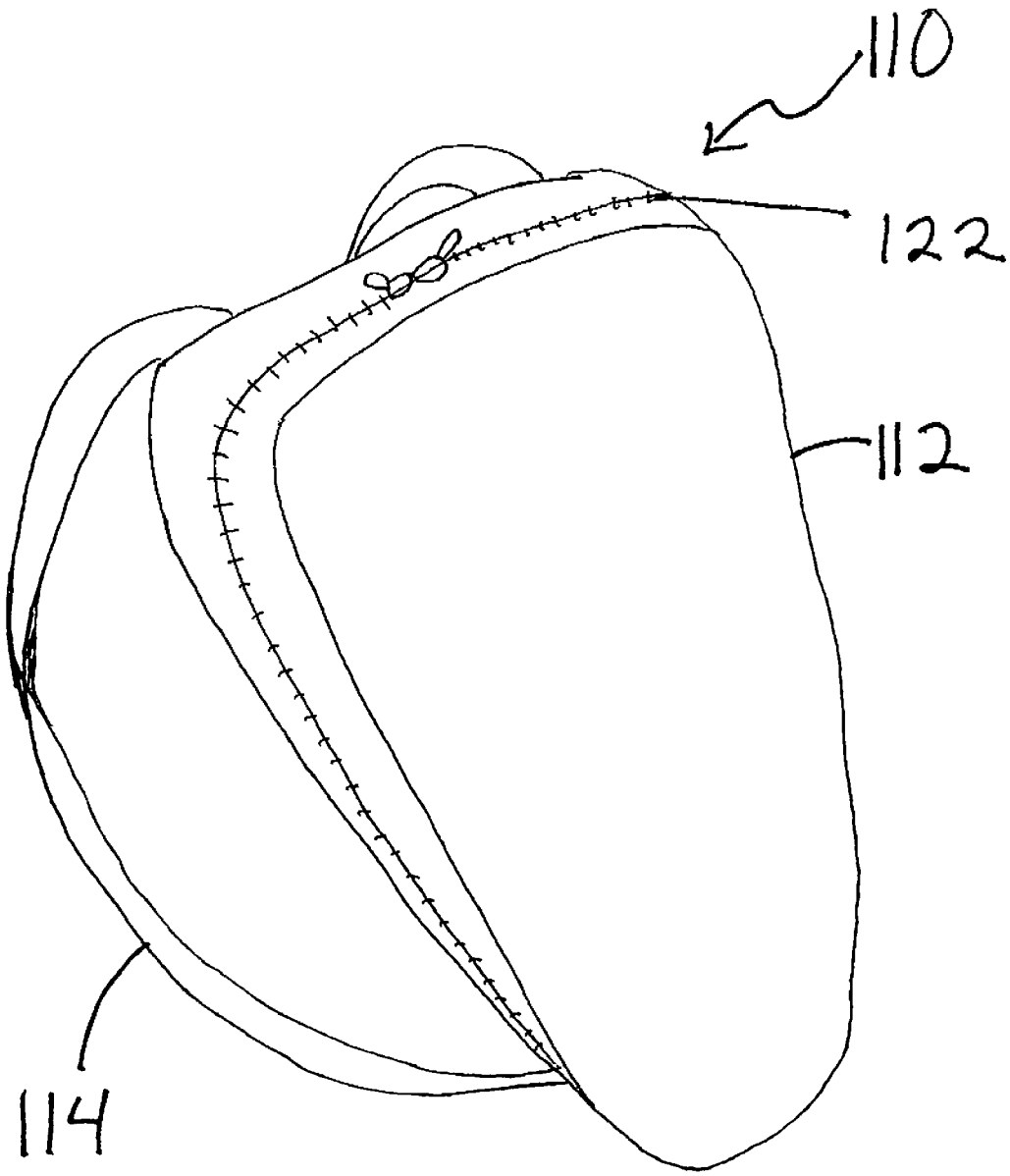
FIG. 3 shows a perspective view of a backpack according to another embodiment of the present invention.

Another embodiment of the backpack 110 of the present invention without a neck support is shown in FIG. 3. Here, a user 100 may access a cargo compartment 112 via a zipper 122. However, one of ordinary skill in the art will appreciate that various other fasteners may be used to secure the cargo compartment 112, such as Velcro or snaps. Further, the straps 114 may be adjustable and/or padded. For example, the straps 114 may have gel or foam inserts or air bladders so that backpack 110 is feels more comfortable on the shoulders of the user 10.

In another embodiment of the present invention, the backpack 10 may have additional pockets or compartments for holding items.

Figure 16:
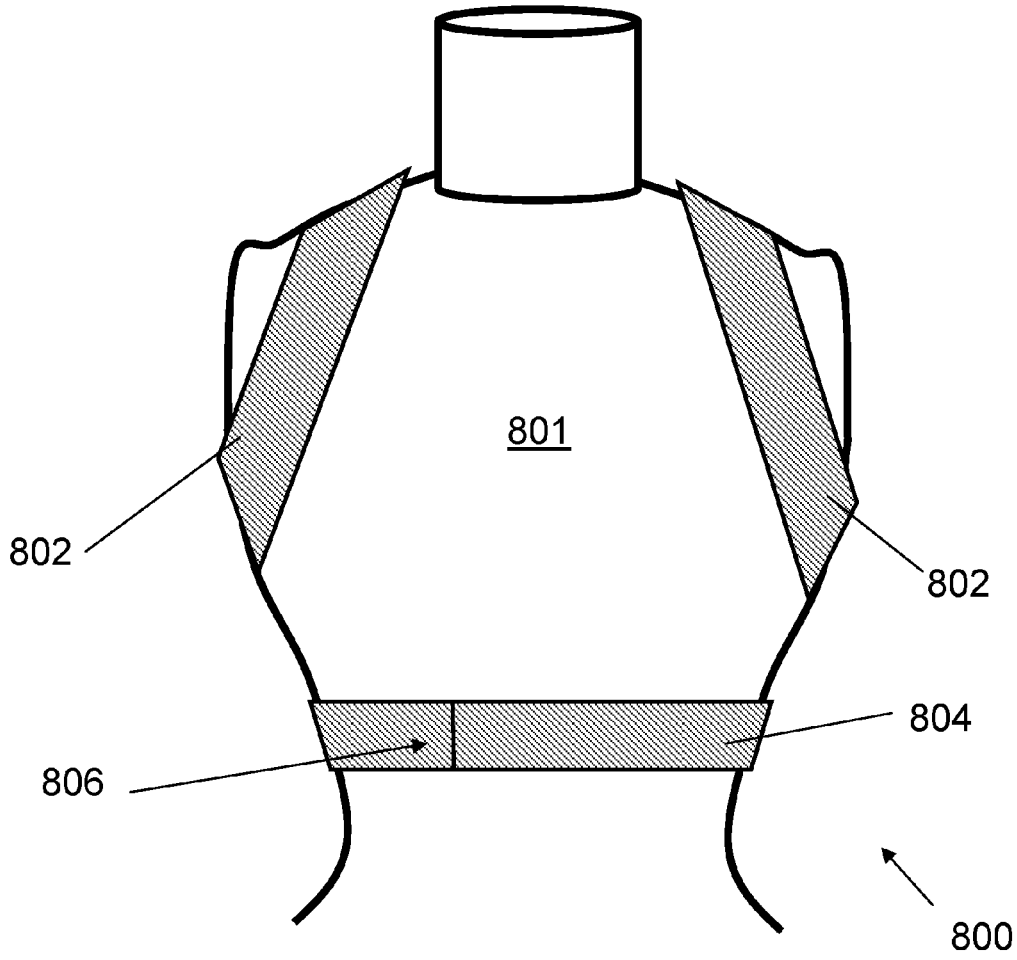
FIG. 16 shows a front view of a posture device according to an embodiment of the present invention.
Figure 17:
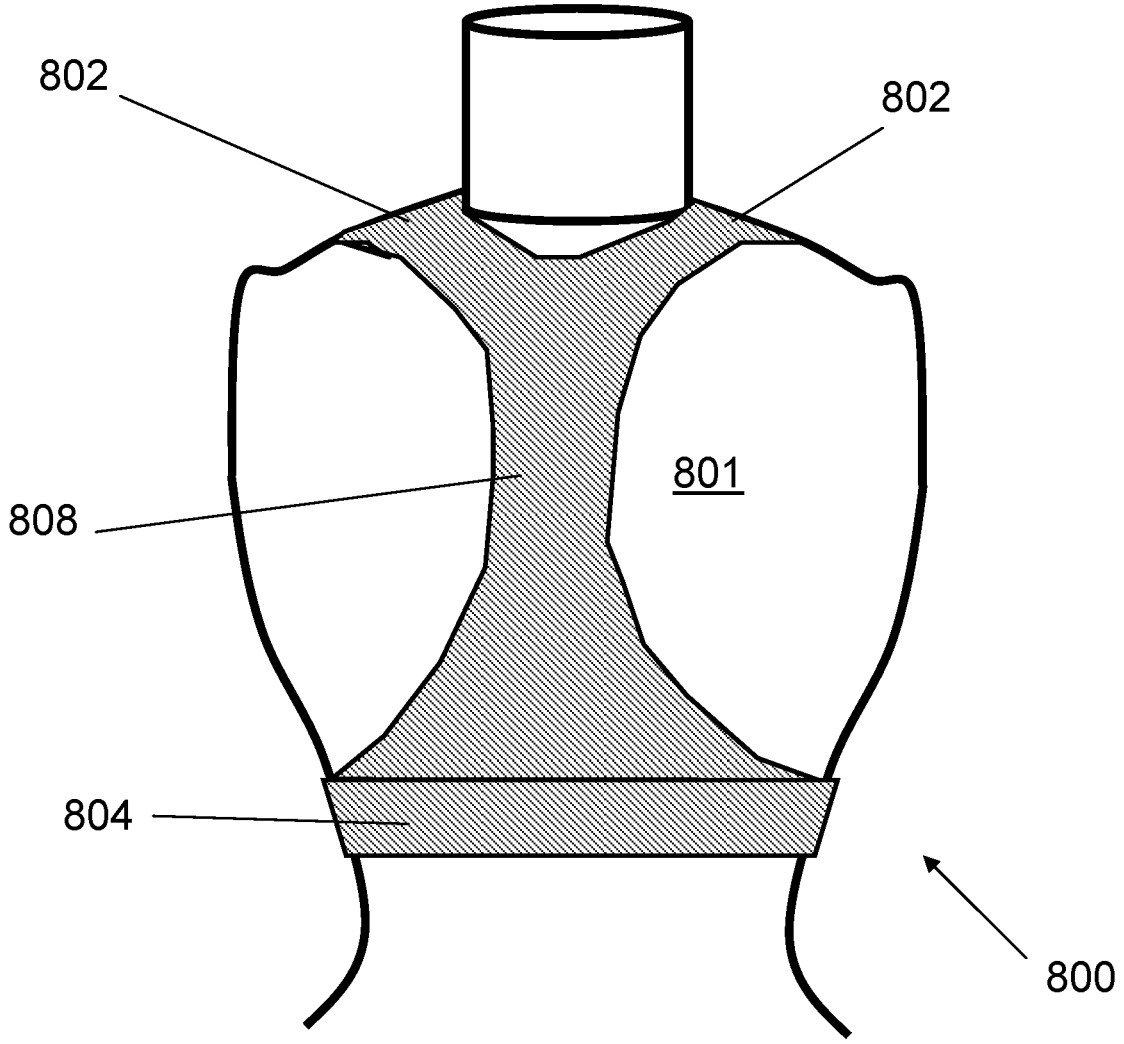
FIG. 17 shows a back view of the posture device from FIG. 16.
Figure 18:
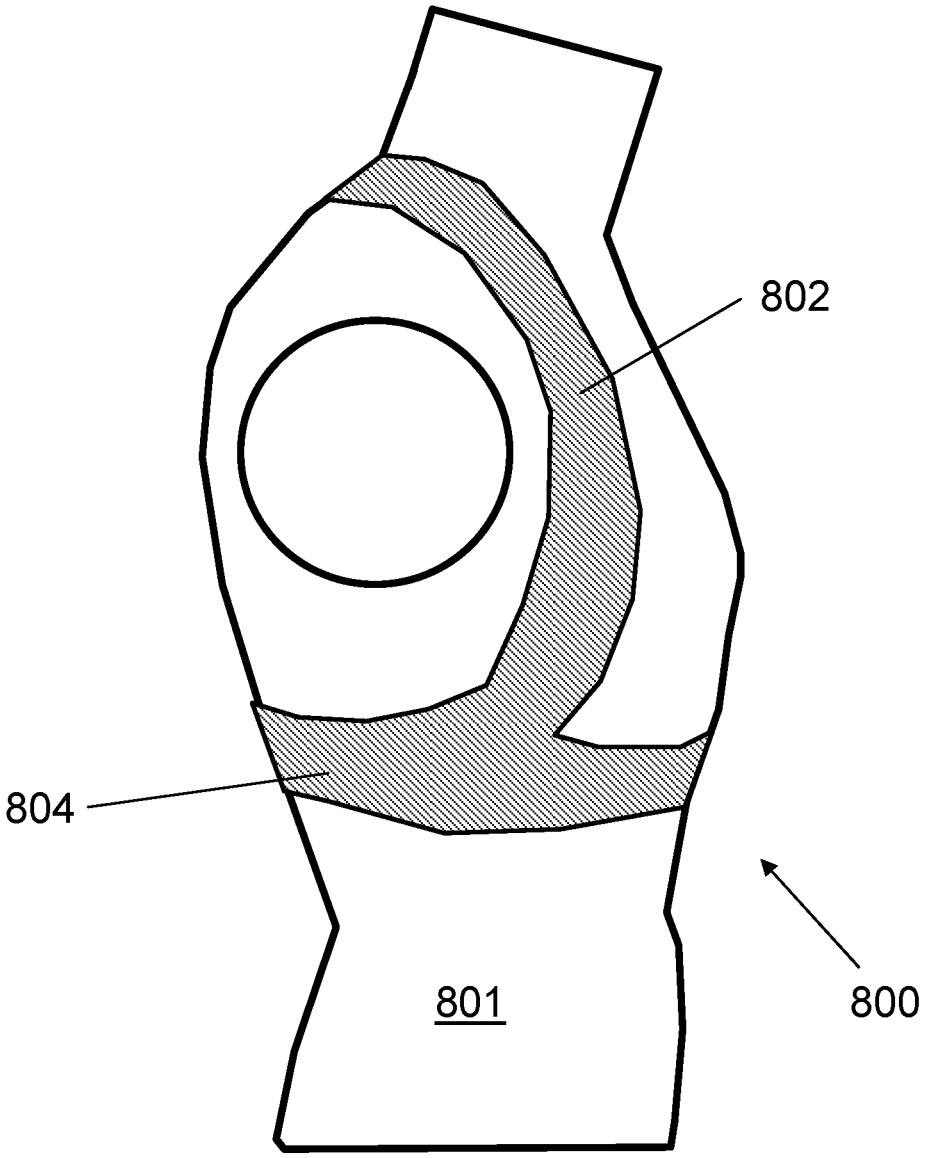
FIG. 18 shows a side view of the posture device from FIG. 16.

FIGS. 16-18 illustrate an embodiment of a posture support device 800 according to the present invention for maintaining a desirable or ergonomic posture. Generally, the support device 800 or brace is composed of one or more strap members or elongated portions of material that are shaped to fit around the torso 801 of a human. These strap members exert force on various locations of the torso 801 and thereby assist the wearer in maintaining desirable or ergonomic back and shoulder posture.

As best seen in FIG. 16, the support device 800 includes two shoulder strap portions 802 that fit over the wearer's shoulders, over the side of the wearer's chest and curve around under the wearer's arms. The lower section of the shoulder strap portions 802 connect to a lower band 804 that encircles a lower portion of the torso 801, as best seen in FIG. 18.

As best seen in FIG. 17, top section of the shoulder strap portions 802 connect together on the back side of the torso 801, forming a single back portion 808. The back portion 808 preferably forms a curved, hourglass shape and connects at its lower section to the lower band 804.

Returning to FIG. 16, the lower band 804 can preferably be selectively opened by a wearer and therefore can have a selective closing mechanism 806. For example, the selective closing mechanism 806 can include a buckle mechanism, hook-and-loop fasteners (e.g., Velcro®), hook connectors (e.g., those commonly found on women's bras), and similar closure mechanisms. Alternately, the lower band 804 may have no closure mechanism 806 and thereby rely on the ability to resiliently stretch over the wearer, then elastically return to a size that conforms to the lower portion of the user's torso 801.

Preferably, portions 802, 808 and 804 are composed of a single, unitary portion of material or can be connected together from several discrete portions of material (e.g., via sewing). Alternately, these portions can be selectively connectable to each other via closure mechanisms such as a buckle mechanism, hook-and-loop fasteners (e.g., Velcro®), hook connectors (e.g., those commonly found on women's bras), and similar closure mechanisms.

The support device 800 is preferably composed of an elastic garment material such as Spandex or elastane and preferably has a relatively small thickness so as to maintain a low profile on the wearer. In this respect, the user can discretely wear the support device 800 under their normal clothes without drawing undue attention to the device 800.

Figure 19:
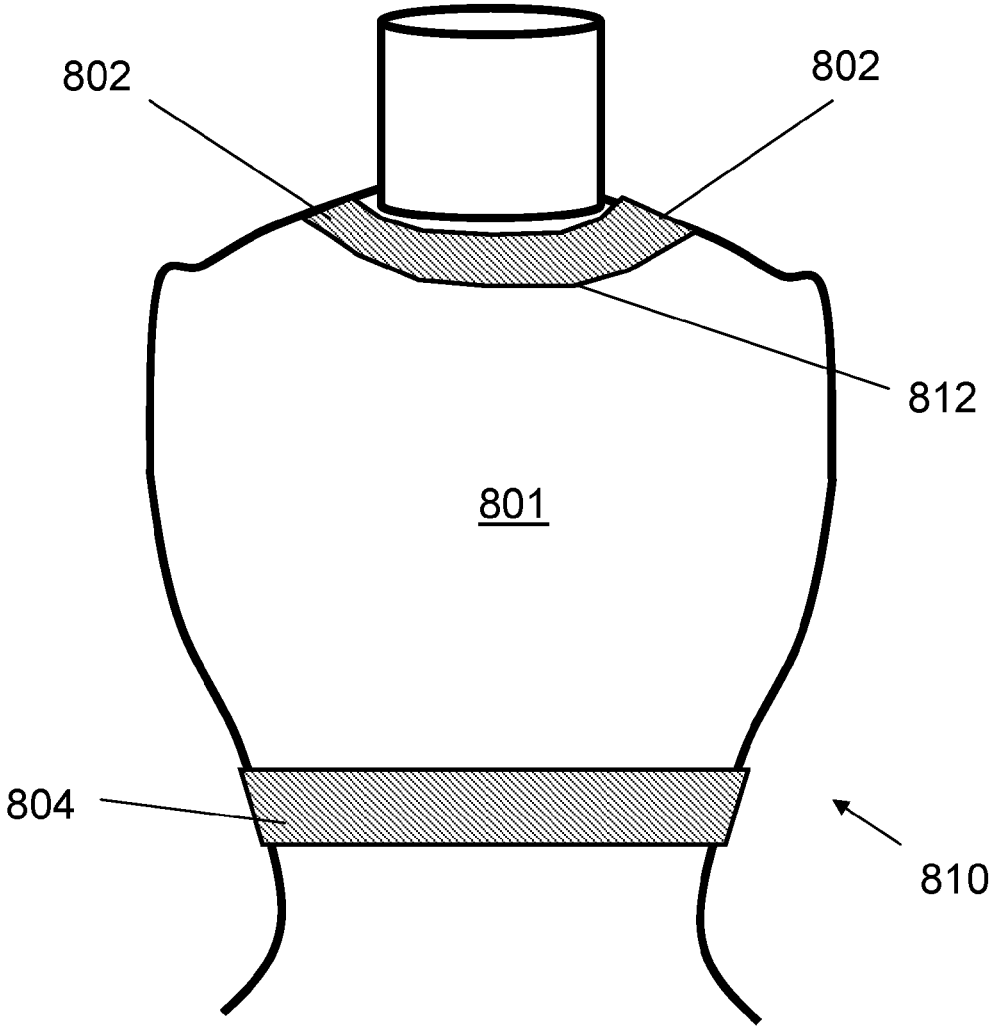
FIG. 19 shows a back view of a second embodiment of a posture device according to the present invention.

FIG. 19 illustrates another preferred embodiment of a support device 810 according to the present invention. This support device 810 is much like the previously described device 800 except that the top sections of the shoulder strap portions 802 connect together in a looping, neck portion 812 that is positioned around the back shoulders/neck of the wearer. This neck portion 812 is not directly attached to the lower band 804, as in the previous device 800. Described another way, the portions 802 and 812 are formed from a single band that is connected on substantially opposing sides of the lower band 804. This band has a length sufficient to pass over portions of the wearer's chest and extend around the back of the wearer's neck.

Figure 20:
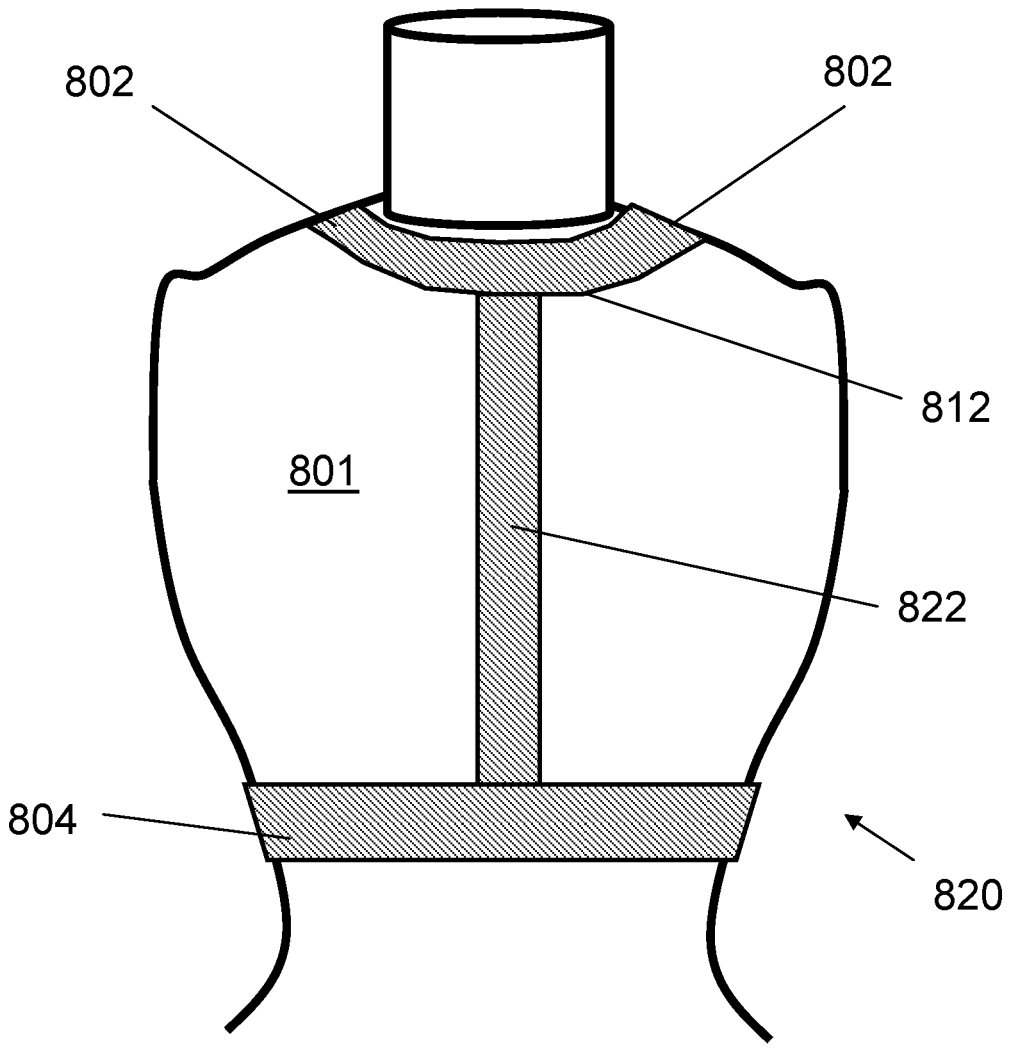
FIG. 20 shows a back view of a second embodiment of a posture device according to the present invention.

FIG. 20 illustrates another embodiment of a support device 820 that is generally similar to the previously described support device 810. However, a vertical back portion 822 is included to connect the neck portion 812 with the lower band 804. Preferably, this back portion 822 is non-removably connected to the lower band 804 and neck portion 812. However, back portion 822 may alternately be selectively connectable at each of its end portions with the back portion 822 and neck portion 812, via closure mechanisms such as a buckle mechanism, hook-and-loop fasteners (e.g., Velcro®), hook connectors (e.g., those commonly found on women's bras), and similar closure mechanisms.

Figure 21:
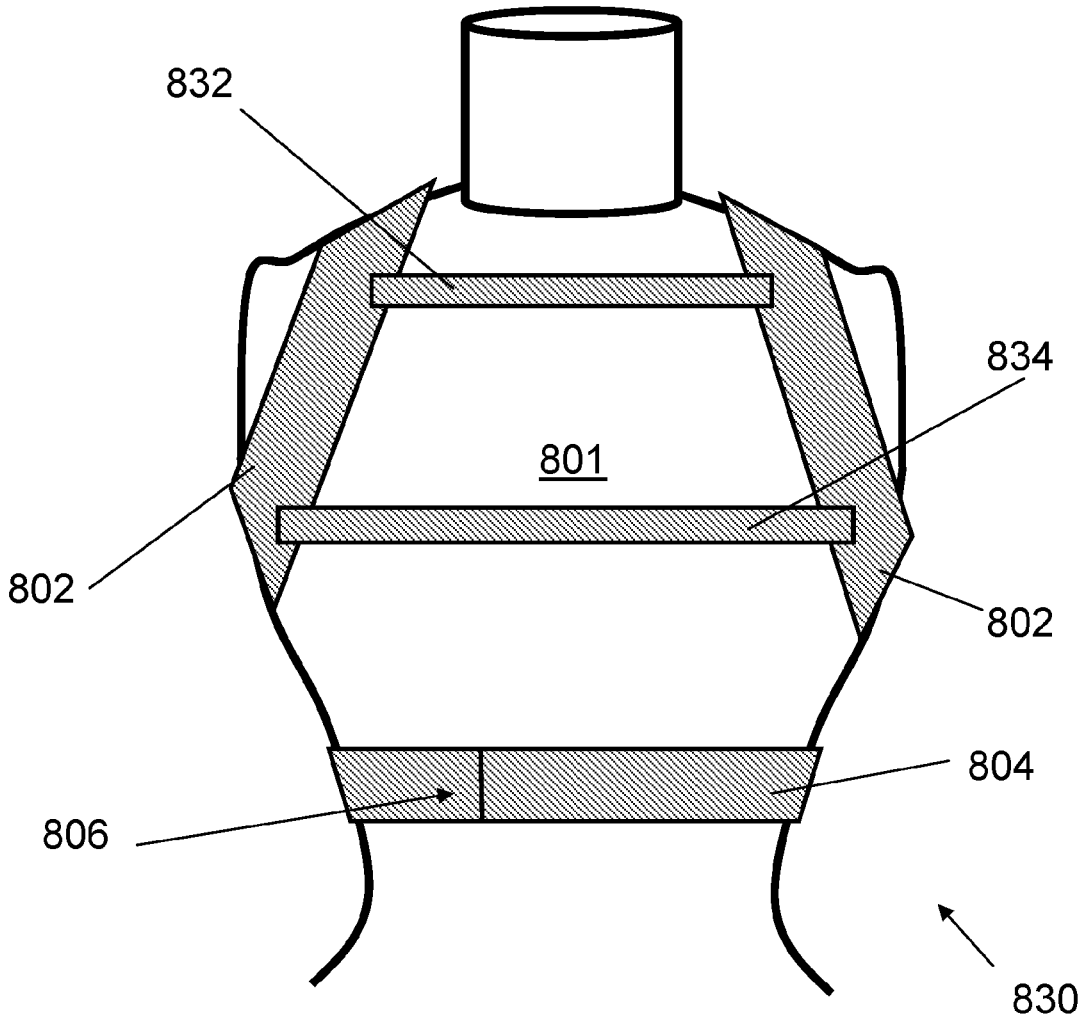
FIG. 21 shows a front view of a second embodiment of a posture device according to the present invention.

FIG. 21 illustrates another embodiment of a support device 830 which is generally similar to the previous support devices 800, 810 and 820. However, and upper chest strap 832 and a lower chest strap 834 are also included. The ends of straps 832 and 834 connect to shoulder strap portions 802 to help maintain the support device 830 in a desired orientation on the wearer. The straps 832 and 834 can be sewn in place or can be removably connected to the shoulder strap portions 802 via closure mechanisms such as a buckle mechanism, hook-and-loop fasteners (e.g., Velcro®), hook connectors (e.g., those commonly found on women's bras), and similar closure mechanisms.

Figure 22:
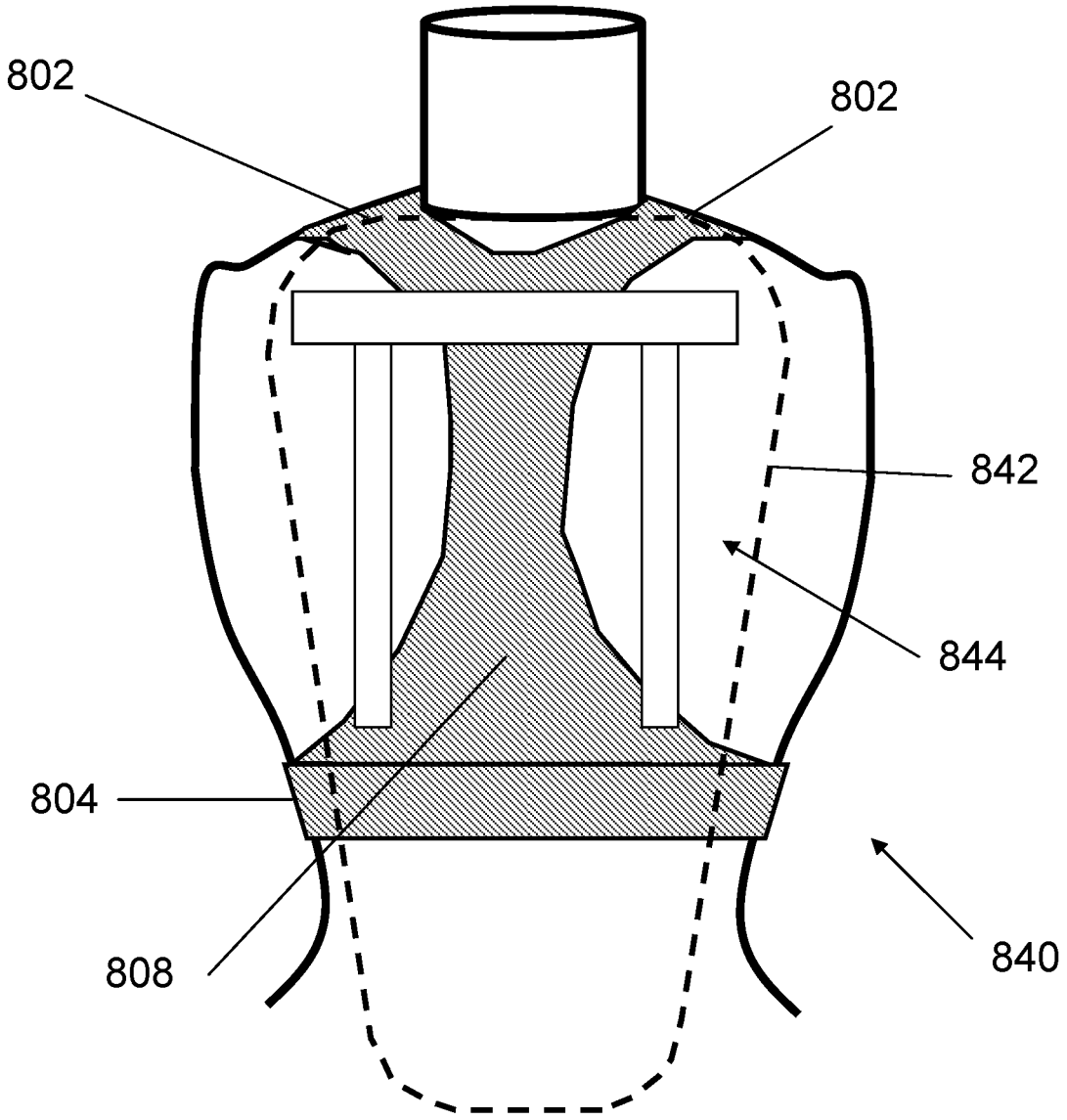
FIG. 22 illustrates a back view of a backpack according to the present invention.
Figure 23:
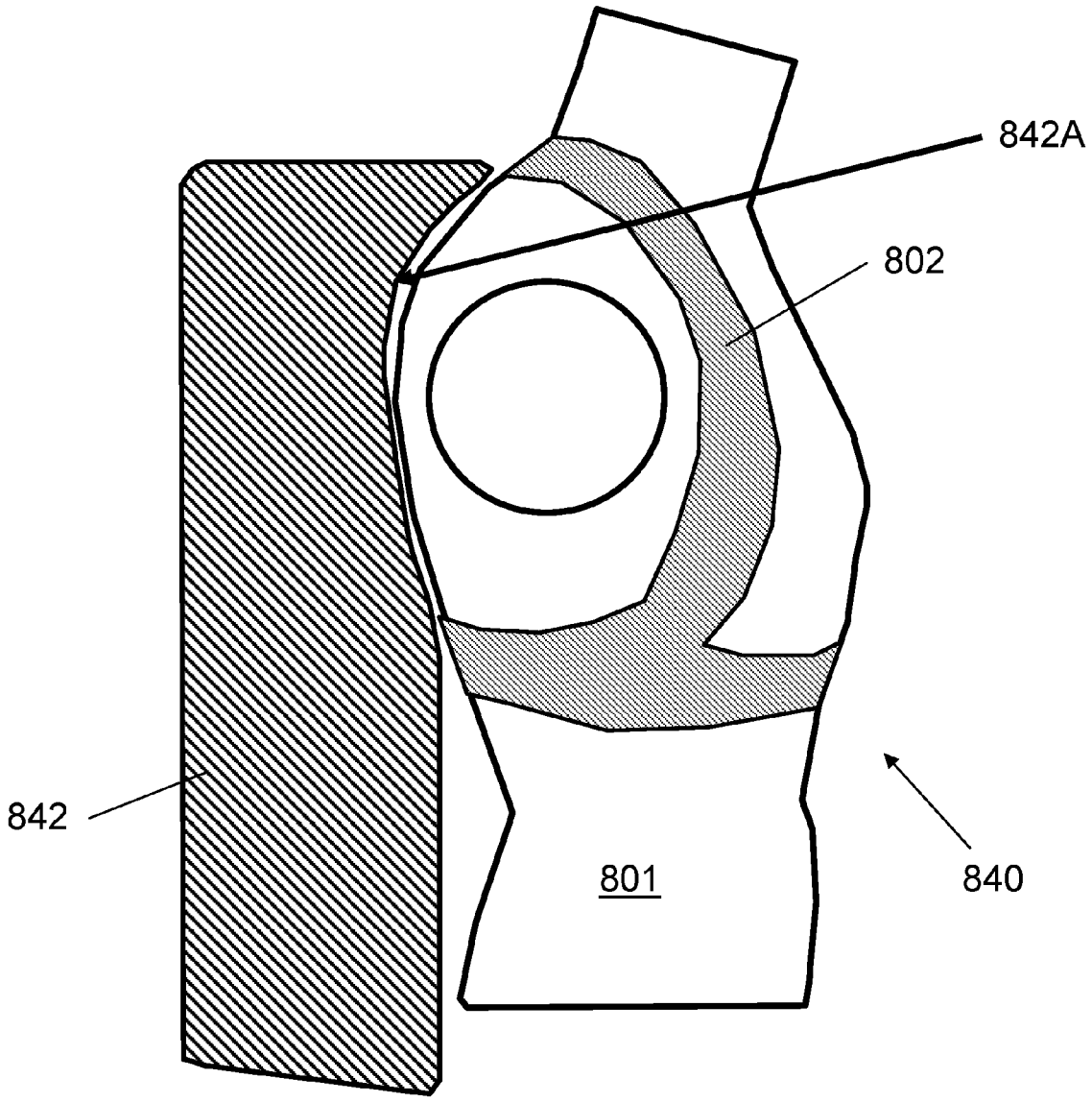
FIG. 23 illustrates a side view of the backpack of FIG. 22.
Figure 24:
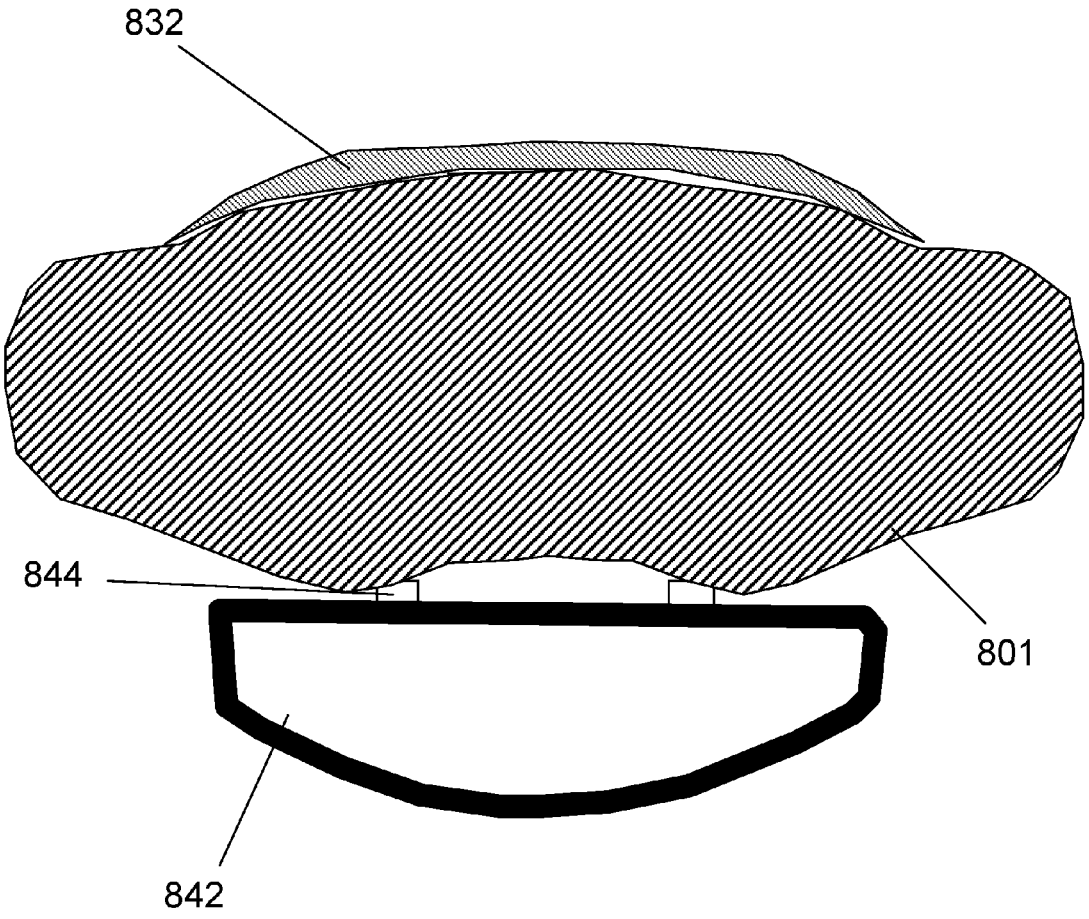
FIG. 24 illustrates a top cross sectional view of the backpack of FIG. 22.

FIGS. 22-24 illustrate another embodiment of a backpack 840 according to the present invention that includes a trapezoid-shaped container portion 842, a frame portion 844 that is connected to the previously described support device 800. As seen in FIG. 23, the upper portion of the backpack 840 is preferably concave, so as to conform to an upper region of a wearer's back.

Figure 25:
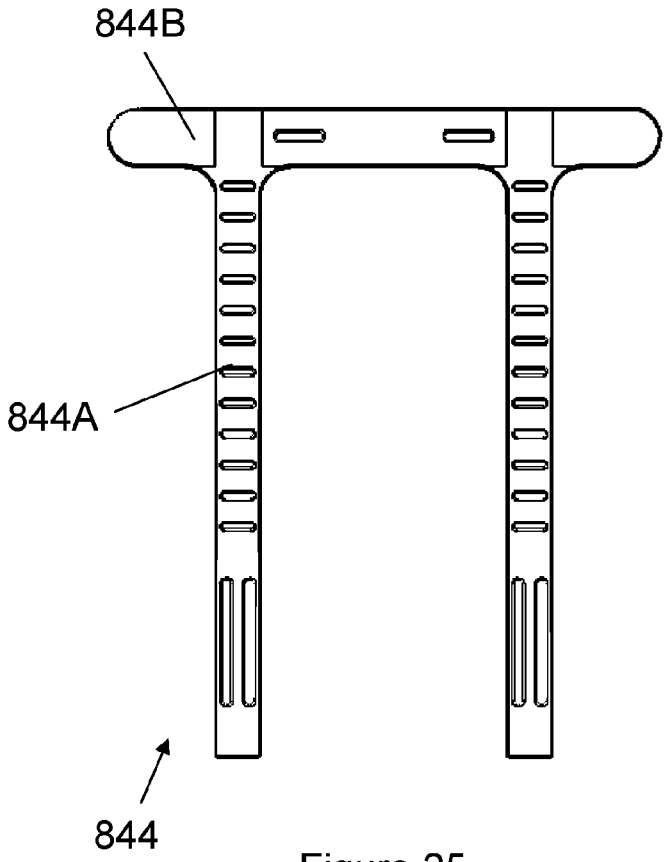
FIG. 25-27 illustrate various views of a frame member of the backpack of FIG. 22.
Figure 26:
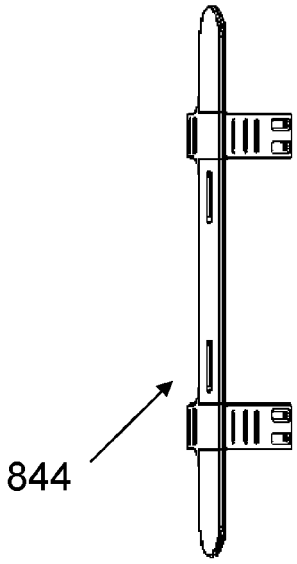
Figure 27:
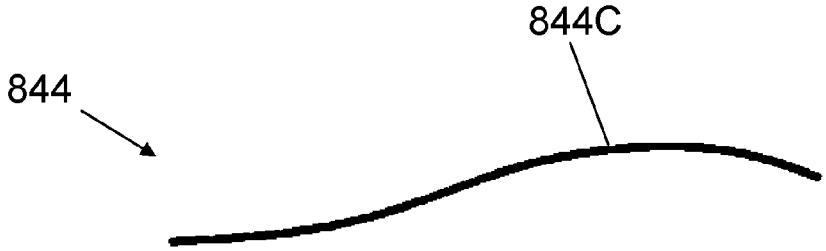
Figure 28:
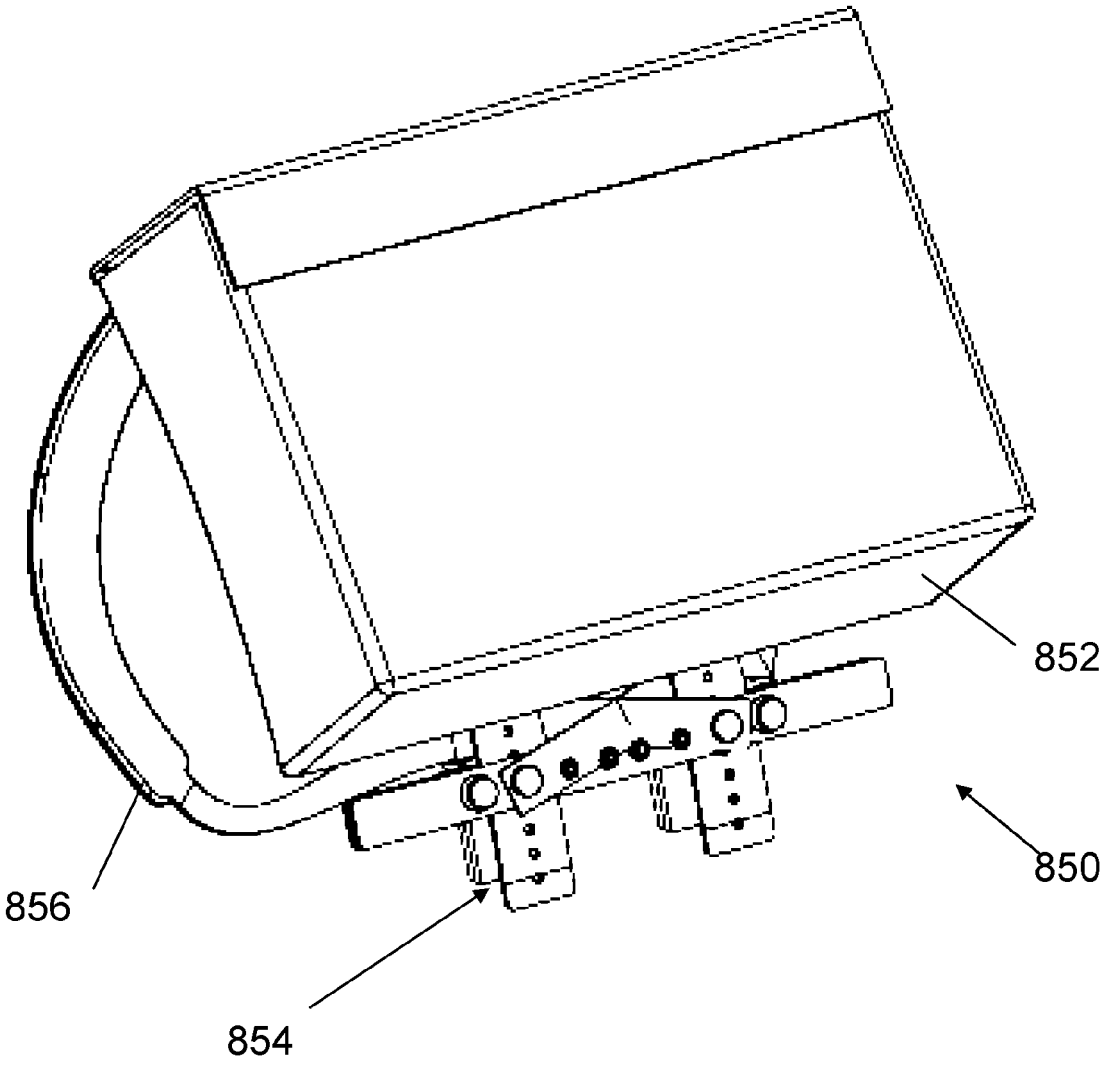
FIG. 28 illustrates a back view of a backpack according to the present invention.
Figure 29:
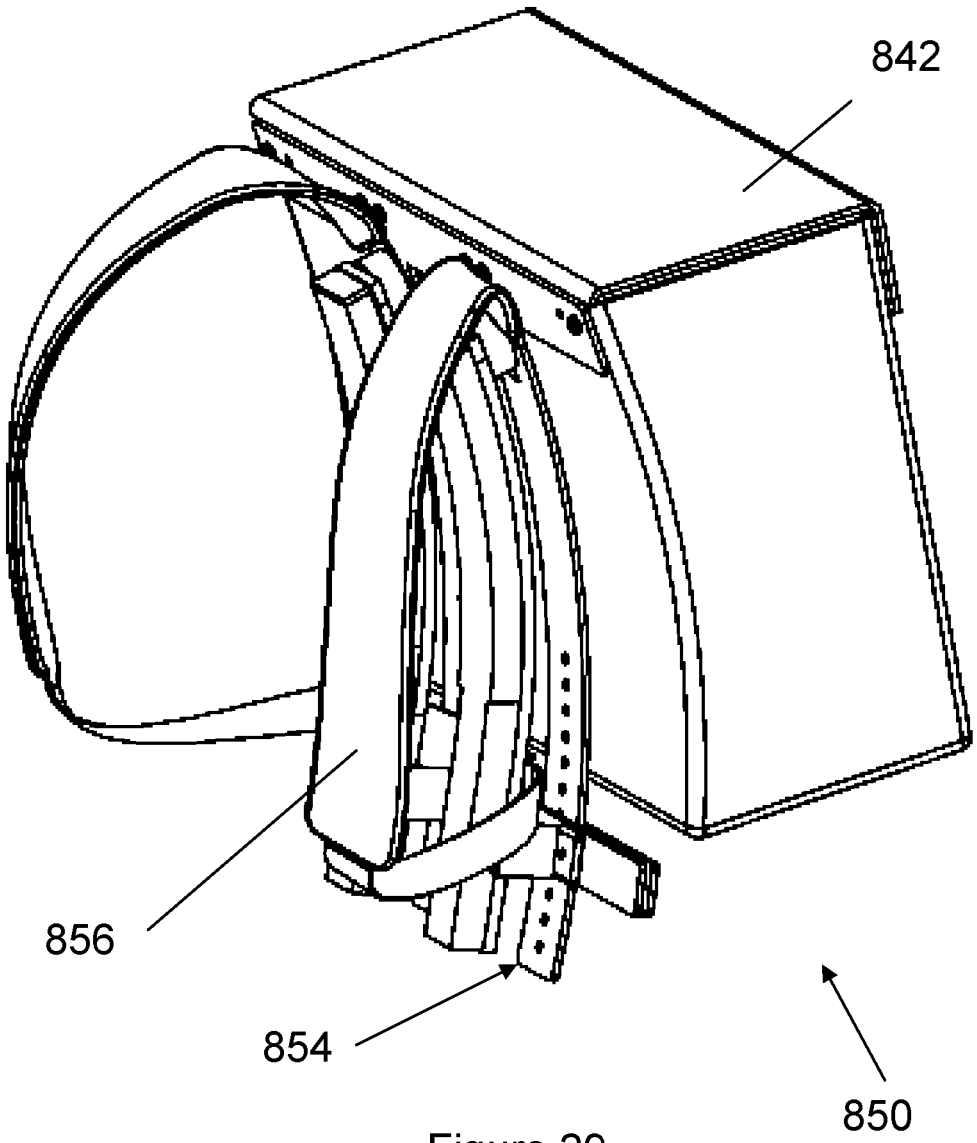
FIG. 29 illustrates a side view of the backpack of FIG. 28.

FIGS. 25-27 illustrate various views of the frame portion 844 which includes an upper, horizontal portion 844B and two lower vertical portion 844A. Both portions 844A and 844B include a plurality of slots sized for straps securing various portions of the backpack 840 together. Hence, different slots can be used to adjust sizing and positioning of various components (e.g., the container portion 842 or connection to the support 800). As best seen in FIG. 27, the frame portion 844 has a curve in it's upper region so as to conform to an upper region of a wearer's back.

Figure 30:
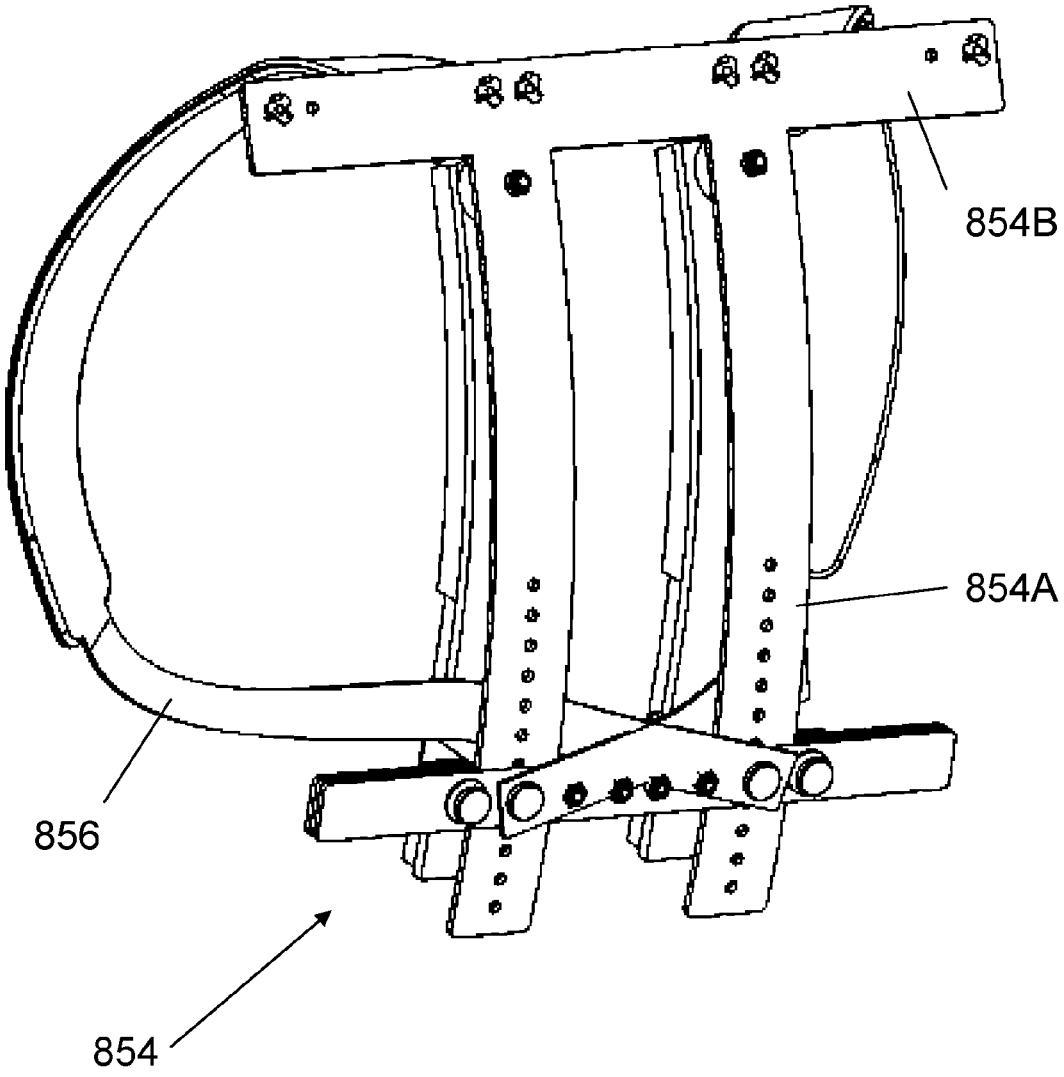
FIG. 30 illustrates a back view of a frame member of the backpack of FIG. 28.

FIGS. 28-31 illustrate another embodiment of a backpack 850 having a square or rectangle container portion 852, straps 856 and a frame member 854. As best seen in FIG. 30, the frame member 854 has a top horizontal portion 854B that is connected to two, spaced apart vertical portions 854A. The vertical portions 854A include a plurality of apertures along their length which provide adjustable connection points for the shoulder straps 856 to connect to.

A second, triangular storage portion 858 can also be removably connected to the frame member 854. This provides the user with an optional and removable second storage area for the backpack 850.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A backpack having a top, a bottom, and a back-facing side comprising:

at least one cargo compartment;

a first strap and a second strap that are each connected near said top of said backpack and near said bottom of said backpack; said first and second straps sized to fit over human shoulders so as to support said backpack;

a first plurality of beads arranged in a generally linear configuration within a first channel along said back-facing side and extending between said top and bottom of said backpack; and a second plurality of beads arranged in a generally linear configuration within a second channel along said back-facing side and extending between said top and bottom of said backpack; and, a plurality of links connected to said first plurality of beads and said second plurality of beads; said plurality of links moving said first plurality of beads and said second plurality of beads towards and away from said top of said backpack, within said first and second channels.

2. The backpack of claim 1, further comprising a flexible material disposed over said first plurality of beads and said second plurality of beads.

3. The backpack of claim 1, further comprising a first elongated frame member curving away from said back-facing side and towards said cargo compartment.

4. The backpack of claim 1, wherein said first strap and said second strap form a back support brace.

5. The backpack of claim 1, wherein said first and said second channels each comprise first and second channels, each composed of rigid material.

6. The backpack of claim 1, wherein said first plurality of beads and second plurality of beads are connected to each other via a cord or a string.

7. The backpack of claim 1, further comprising a first elongated frame member forming said first channel and a second elongated frame member forming said second channel.

8. The backpack of claim 1, wherein said first and second plurality of beads are parallel with each other.

9. The backpack of claim 1, wherein said plurality of links are movable selected from: a manually actuated movement mechanism and or a motorized movement mechanism.

10. The backpack of claim 1, wherein said plurality of links are manually actuated such that pulling on a cord or a string connecting said first and second plurality of beads resulting in moving said first plurality of beads and said second plurality of beads within said first and said second channels.

11. The backpack of claim 1, wherein said first and second channels are connected to each other so as to provide a pathway for said first and second plurality of beads between said first and second channels.

12. The backpack of claim 1, further comprising a neck support disposed at said to of said backpack and positioned to support a human neck.

13. The backpack of claim 12, wherein said neck support is height adjustable.

14. A backpack having a top, a bottom, and a back-facing side comprising:

a cargo compartment;

a first strap and a second strap that are each connected near said top of said backpack and near said bottom of said backpack; said first and second straps sized to fit over human shoulders so as to support said backpack;

a plurality of generally spherical members that extend between said top and said bottom of said backpack and connected via a cord member within a channel along a side of said backpack; and said cord member moving said plurality of generally spherical members towards and away from said top of said backpack when said cord members is pulled.

15. A backpack having a top, a bottom, and a back-facing side comprising:

a cargo compartment;

a first strap and a second strap that are each connected near said top of said backpack and near said bottom of said backpack; said first and second straps sized to fit over human shoulders so as to support said backpack; and, a plurality of generally spherical members that extend between said top and said bottom of said backpack, are located in a first and a second channel, and are covered by a flexible material; and, a cord member moving said plurality of generally spherical members towards and away from said top of said backpack.

16. The backpack of claim 15, wherein said plurality of generally spherical members are linked together.

17. The backpack of claim 15, wherein said plurality of generally spherical members are arranged in two parallel rows.

18. The backpack of claim 16, wherein said cord member connected to each of said plurality of spherical members within said first and said second channels.

* * * * *